US005636421A

United States Patent [19]

Brams

[11] Patent Number: 5,636,421

[45] Date of Patent: Jun. 10, 1997

[54] METHOD OF MANUFACTURING AN ARTICLE OF JEWELRY HAVING FAUX PAVÉ LOOK

[76] Inventor: Peter Brams, 7002 Blvd. East, Guttenberg, N.J. 07093

[21] Appl. No.: 342,094

[22] Filed: Nov. 18, 1994

[51] Int. Cl.[6] ..... B23P 13/04

[52] U.S. Cl. ..... 29/160.6; 63/2; 63/28

[58] Field of Search ..... 29/160.6; 63/2, 63/28

[56] References Cited

U.S. PATENT DOCUMENTS 4,761,865 8/1988 Hagnien et al. ..... 63/28

FOREIGN PATENT DOCUMENTS 197871 10/1986 European Pat. Off. ..... 63/2

*Primary Examiner*—P. W. Echols

*Attorney, Agent, or Firm*—Levisohn, Lerner, Berger & Langsam

[57] ABSTRACT

A method for producing an article of jewelry having a faux pavé diamond look. According to the method, at each location where a faux pavé diamond is desired, an upwardly extending cylinder is located. The top circular surface of the cylinder is scored or chiseled, first across a diameter to produce a pair of upwardly and outwardly extending inclined semicircular surfaces. Angled thereto, a second chiseling is provided to produce a plurality of upwardly and outwardly inclined surfaces, extending from the center of the cast cylinder. The top surface of the cast cylinder is then plated with rhodium.

10 Claims, 2 Drawing Sheets

METHOD OF MANUFACTURING AN ARTICLE OF JEWELRY HAVING FAUX PAVÉ LOOK

BACKGROUND OF THE INVENTION

The present invention relates to a method for manufacturing an article of jewelry having the appearance of pavé diamonds. According to the method of the present invention, the pavé diamond look is not made by utilization of real diamonds or even diamond chips but, rather, the present invention contemplates a process wherein metal cylinders are formed at the desired locations of the pavé diamonds and the cylinders are then chiseled or molded across their top surfaces to create opposed slopes. A rhodium finish is then applied to the chiseled top sloped surfaces. In this manner, as will be more fully explained, a faux pavé diamond appearance is provided to an article of jewelry, without the attendant cost of diamonds or even diamond chips.

The present invention relates to a method of forming a pav é diamond look and, therefore, it is particularly appropriately used in connection with articles of jewelry. However, it should be appreciated that the method of the invention can be used to decorate a wide variety of articles of manufacture including, for example, belt buckles, womens handbags, writing instruments, etc. Thus, the method of the present invention can be incorporated into any article of fashion or fashion accessory to the extent that a "flashy" or "rich" pav é diamond look is desired. The present invention, as will be appreciated, accomplishes the look of pavé diamonds without the attendant expense of the diamonds themselves nor the labor intensive cutting and mounting of diamonds.

SUMMARY OF THE PRIOR ART

Current jewelry design and fashion accessories often seek to provide a rich look. This, of course, can be provided by real diamonds. Individual faceted diamonds are very expensive and time consuming to mount. Thus, pavé diamonds have become more common. This look uses diamonds but no individual prong mountings. Rather, the diamonds, or diamond chips, are held in metal molded around the gems. Even pavé diamonds, however, can be expensive. Diamonds are still required. The present invention provides a pavé diamond look without the use of diamonds. Thus, a brilliant or "flashy" look is provided while maintaining relative low cost, rather than utilizing full-cut diamonds. The present invention, to the extent it provides a brilliant or "flashy" appearance, without the necessity of utilization of diamonds or chips or individual mountings for the diamonds is very economical. In addition, the ease of manufacture, by use of the present invention, allows for far more articles of fashion accessory and articles of jewelry to be manufactured since the method of the present invention can be easily adapted to a wide variety of final product designs.

It is an object of the present invention, therefore, to provide a brilliant, glistening, or "flashy" appearance to an article of jewelry or fashion accessory.

It is a further object of the present invention to provide an article of jewelry having apparent "fire," with relative minimal cost with respect to cost of the actual goods and, in addition, and of possibly even more significance, without the attendant labor costs in mounting of diamonds and diamond chips.

Accordingly, it is an object of the present invention to provide an article of jewelry or other fashion accessory which exhibits a glistening or bright appearance and, yet which does not utilize diamonds or diamond chips.

It is a further object of the present invention to provide an article of jewelry having the desired pavé look without the base metal behind the diamonds conventionally used in a pavé setting. This, too, saves material and associated labor costs and reduces the ultimate cost of the article of jewelry.

It is an object of the present invention to provide an article of jewelry having the desired brilliant, glistening or flashy look which is produced by a simple, inexpensive, process which can be applied to a wide variety of goods and designs. Reducing the cost of material as well as the labor intensive costs of setting diamonds is a desired goal of the present invention.

SUMMARY OF THE INVENTION

The present invention relates to a method for manufacturing an article of jewelry or fashion accessory. The article of jewelry, when made according to the present invention, exhibits the appearance of pavé diamonds. Conceivably, when the article is viewed form a distance, the article of jewelry even has the appearance of individually prong set, brilliant cut, faceted diamonds. The appearance is, however, made from metal, no gems are employed.

According to the present invention, a sketch of the article of jewelry is first made. A model is then formed, entirely of metal, preferably silver. At the locations where the individual diamond look or pavé diamond appearance is desired, the craftsman then secures, by welding, soldering or other conventional technique, small metal cylinders. A wax casting is then produced, consistent with conventional jewelry techniques, from the metal model of the article of jewelry. From the wax casting, a final metal casting is produced, again, consistent with conventional jewelry casting techniques. This metal casting is a three-dimensional embodiment of the designer's sketch and, in addition, bears metal cylinders at the locations where the designer designated the pavé diamond appearance. The individual cylinders are formed from metal, preferably gold or silver, the same metal used for the ultimate jewelry product intended to be sold to the consumer.

Consistent with the present invention, each individual cylinder is then chiseled, downwardly, with a diamond cut fly-wheel. A score or cut in a first direction across the cylinder's end face is thus formed. It is located at the diameter of the cylinder's end face. The chiseling results in a pair of opposed, semi-circular, upwardly inclined surfaces (from the diameter). The chiseling can also be performed by a small chisel since the metal used for the article of jewelry is generally soft enough such that chiseling downwardly creates two opposed, inclined surfaces meeting at the common center diameter.

Subsequently, each individual cylinder, now having two opposed inclined surfaces, is chiseled or cut again, using the same diamond cut fly-wheel or chisel, this time, at 90° to the first chiseling operation. To vary the positioning of the reflective surfaces of each cylinder, the second cut varies from about 90° to 150° to the first cut. This results in two additional inclined surfaces for each of the original two inclined surfaces. Thus, a multiple, faceted surface to the original cylinder results. The upwardly extending four inclined surfaces (basically corresponding to quadrants of the circular end face of the cylinders) of the cylinders are then plated with rhodium. The rhodium is shiny or made shiny by polishing and provides the jewelry and, in particular, the inclined surfaces of the cylinder of the jewelry product with a brilliant look quite similar to pavé diamonds. A gemstone, to the extent provided in the original sketch of the overall jewelry design is then conventionally mounted. The article of jewelry is then ready for wholesale and subsequent retail sale to the consumer.

BRIEF DESCRIPTION OF THE DRAWINGS

In order to more fully understand the method of the invention, it will now be described by way of example, with reference to the accompanying drawings, in which:

FIG. 1 is a top plan view of the sketched ring design.

DETAILED DESCRIPTION OF THE DRAWINGS AND THE PREFERRED EMBODIMENT OF THE PRESENT INVENTION

As mentioned, the present invention is particularly suitable for manufacture of articles of jewelry. Consistent with the preferred embodiment of the present invention, it is illustrated and described in connection with a woman's ring design. The drawings show the invention for a woman's ring from initial concept by a designer to fabrication into a final product. In the final product intended to be offered for sale by the manufacturer of the article of jewelry to wholesalers and as intended to be ultimately resold to retail consumers, the present invention, in the design shown in FIGS. 1 through 8, will have a center gem of a precious or semi-precious stone. For illustration purposes, however, the semi-precious or precious center gemstone is not shown. It will be appreciated that the final product, as sold by the retailer, will have a center gemstone mounted in place in a conventional manner.

The present invention primarily concerns that aspect of the design shown in FIGS. 1–8 wherein the gemstone is surrounded, on both sides, with a design which is intended to have a faux pavé diamond look or, when viewed from a distance, the look of a plurality of individually mounted diamonds adjacent to the center gemstone. As previously discussed, the present invention can be used in a wide variety of jewelry designs, and in addition, can be incorporated into other fashion accessories and articles of manufacture as well. For ease of illustration, however, the present invention is described and illustrated in connection with a woman's ring design.

Figure 1:
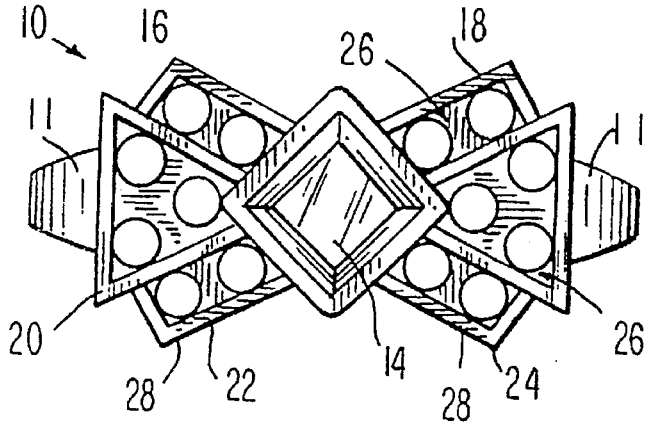
FIG. 1 is a sketch of one embodiment of the present invention as used in connection with the design and manufacture of a woman's ring having a central gemstone surrounded, on its sides, with the faux pavé diamond look of the method of the present invention.

FIG. 1 shows a black and white sketch of the woman's ring design of the present invention. The sketch is created, in conventional manner, by the jewelry designer. FIG. 1 has a design 10 shown in a top plan view. Jewelry design 10, when viewed from the top, shows ring segments 11 extending from both sides of the design. The ring segments 11, extending from both sides of the ring design 10, of course, form a ring and is that portion of the article of jewelry which is placed over a finger of the wearer. Consistent with conventional techniques, the ring segments and the ring are sized for the wearer's finger size. In the embodiment of the invention shown in FIG. 1, the center gemstone 14, in this case, a square cut gem will be used. The gemstone 14 will be secured in a conventional manner either by prongs, gluing, bonding or other conventional jewelry techniques. Adjacent to the center gemstone 14 are a pair of wings 16 and 18, comprised of a triangular section 20 and a pair of adjacent rectangular sections 22 and 24. Each of the sections 20, 22 and 24 are provided with one or more faux pavé diamond locations 26. In the drawing of the invention shown in FIG. 1, each of the faux pavé diamond locations 26 correspond to a small circle. As will be appreciated, the triangular section 20 is provided, in this design embodiment, with three faux pavé diamond locations 26, while each of the rectangular adjacent sections 22 and 24 for each of the wings 16 and 18 are provided with two faux pavé diamond locations 26. The triangular section 20 as well as each of the rectangular sections 22 and 24 are bordered by walls 28 which, consistent with the design shown in FIG. 1, are intended to be formed of precious or semi-precious metal.

Figure 2:
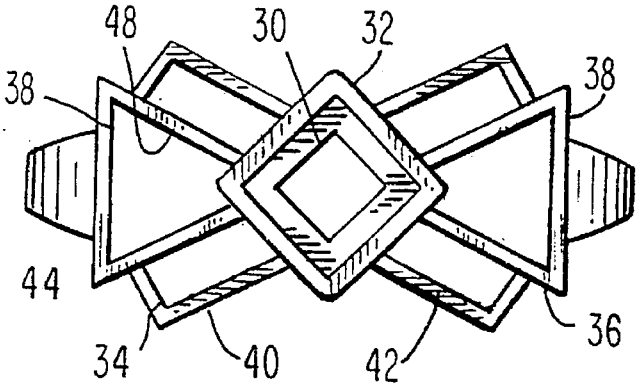
FIG. 2 is a top plan view of a silver model made by a jewelry craftsman from the sketch of FIG. 1, before the individual cylinders are located in the model at the sites where the faux pavé diamond look is to be placed.

From the sketch of the jewelry design 10 shown in FIG. 1, a jewelry craftsman or artisan will form a silver model of the design. This can be seen in FIG. 2. A center gemstone mounting 30 is provided in the silver model 32. Extending outwardly from both sides of the center gemstone mounting 30 are a pair of model wings 34 and 36, corresponding to sketched wings 16 and 18, respectively, of the sketch of the design shown in FIG. 1. Each wing 34 and 36 is provided with a triangular model section 38 and a pair of adjacent rectangular model sections 40 and 42. The triangular model section 38 corresponds to sketched triangular section 20 of the design shown in FIG. 1, while the rectangular model sections 40 and 42 correspond in size and shape to the sketched rectangular sections 22 and 24 of the design of the invention shown in FIG. 1. The model 32 shown in FIG. 2 is, of course, provided with model ring segments 44 which extend toward one another and form a ring of suitable size for wearing by the individual. As will be appreciated by a review of FIG. 2, the triangular model section 38 and the rectangular model sections 40 and 42 are not, at this point in the process, provided with any material at the corresponding locations 26 of the faux pavé diamonds as shown in the sketch of the design shown in FIG. 1.

Figure 3:
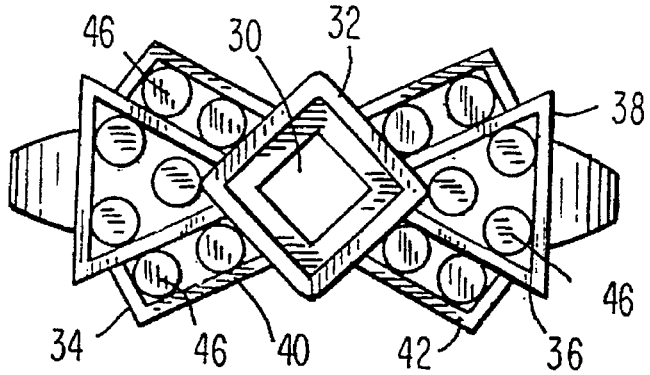
FIG. 3 is a top plan view of the model of FIG. 2, after small, metal cylinders have been secured into the jewelry design of the model, at the sites where the faux pavé diamond look is to occur.

FIG. 3 shows the model 32 after metal cylinders 46 have been soldered, welded or otherwise conventionally secured in place at the faux pavé diamond locations 26, shown in FIG. 1. Each metal cylinder is, preferably, formed from silver or other conventional metal used in jewelry model making. Each metal cylinder 46 is soldered in place by securing the same to walls 48 of the triangular model section 38 and to the walls of the rectangular model sections 40 and 42 and, in addition, adjacent metal cylinders 46 can be further secured in place by securing them to one another, as desired. The soldering of the metal cylinders to the walls of the ring and to one another occurs substantially at the bottom surfaces and edges of the cylinders.

In the embodiment of the invention shown in FIG. 3, triangular model section 38, on each of the wings 34 and 36 are provided with three metal cylinders 46, while each of the rectangular model sections 40 and 42, again, for each of wings 34 and 36 are provided with two, upwardly projecting metal cylinders. The metal cylinders extend to the base of the walls 48 and, in the preferred embodiment, do not project downwardly therefrom. They do, however, extend above the top of the walls 48. The diameter of the metal cylinders 46 is selected to correspond to the jewelry design. More specifically, each metal cylinder will, when the method of the present invention is completed, correspond to the appearance and location of an individually mounted gemstone or a pavé diamond.

Figure 4:
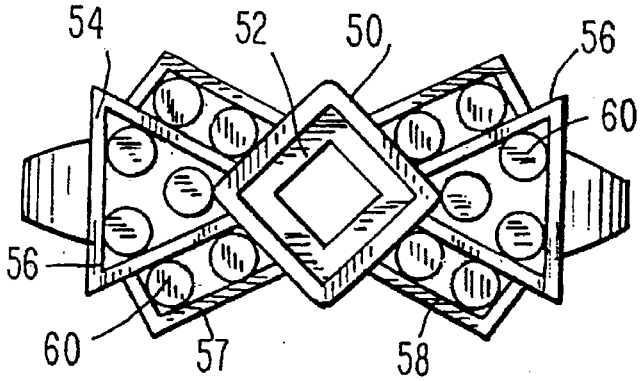
FIG. 4 is a top plan view of a wax casting of the model of the ring shown in FIG. 3.
Figure 5:
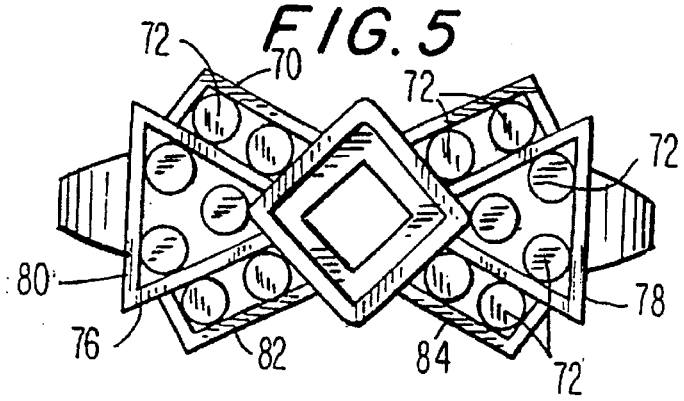
FIG. 5 is a top plan view of a casting made from gold, from the wax model of FIG. 4, using the conventional lost wax process of jewelry casting.

From the model of the invention shown in FIG. 3, with the metal cylinders in place, a wax model 50 is formed (See FIG. 4). This is made directly from model 32 by utilization of conventional jewelry manufacturing techniques. As will be appreciated, the wax model 50 (seen in FIG. 4) includes a wax model center mounting 52 for a gemstone and wax wings 54 and 56. The wax wings 54 and 56 correspond to model wings 34 and 36 of the model of FIGS. 2 and 3 and each of the wax wings have triangular wax sections 55 and rectangular wax sections 57 and 58. A plurality of wax cylinders 60 are formed and correspond in location to the metal cylinders 46 of the model 32 shown in FIGS. 2 and 3.

Utilizing the lost wax method of jewelry casting or any other conventional casting technique, a casting 70 (See FIG. 5) is produced from the wax model 50 of FIG. 4. Preferably, the casting 70 is made from pure gold or a gold composition, preferably 14 or 18 carat gold. It is, however, consistent with the present invention for the casting to be made from silver or any other metal. It is, however, an aspect of the present invention for the cast cylinders 72 to be made from a metal which is soft or malleable to the extent a tool can be used to form score or cut lines 75 on the top surfaces thereof. Preferably, a diamond cut fly wheel can be used to cut lines 75 into the cylinders. Alternatively, the cylinders are molded or cast with sloped surfaces (described hereinafter). The casting 70 includes a cast center gem mounting 74 and a pair of wings 76 and 78 extending outwardly therefrom. Of course, the top plan view of the design shown in FIG. 5, consistent with the other views, does not completely show the ring segments nor the circular ring of the present invention but it will be appreciated by those of ordinary skill in the art that the design includes such a ring for wearing on a finger. Each of the wings 76 and 78 comprises a triangular cast section 80 and a pair of adjacent rectangular cast sections 82 and 84. Each of the triangular cast sections 80 and rectangular cast sections 82 and 84 include cast cylinders 72, which correspond in size, shape and location to the faux pavé diamond locations 26 shown in FIG. 1, to the metal cylinders 46 shown in FIG. 3, as well as to the wax cylinders 60 shown in FIG. 4.

Figure 6:
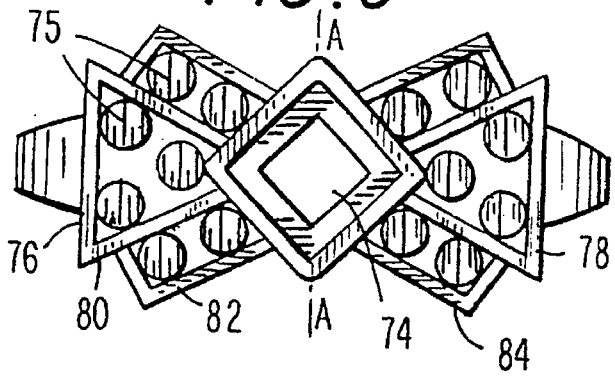
FIG. 6 is a top plan view of the ring embodiment of the present invention, after having been cast in metal and after the top surfaces of the cylinders have been scored, cut or chiseled, so that they have two upwardly inclined, opposed semicircular surfaces extending from a diameter.
Figure 6A:
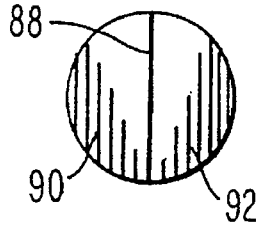
FIG. 6A is an enlarged, top plan view, of a scored or chiseled cylinder, made consistent with the present invention as of the completion of the step shown in FIG. 6.

Consistent with the method of the present invention, the top circular surface 86 (the cylinder end) of each of the cast cylinders 72 is chiseled by a diamond cut fly wheel or hammered downwardly with a V-shaped tool or chisel, i.e., scored or otherwise provided with a diameter line 88 (see enlarged view FIG. 6A) and a pair of opposed, outwardly and upwardly extending from the diameter line 88, inclined, semicircular surfaces 90 and 92. This is best seen in FIGS. 6 and 6A. According to the preferred embodiment of the present invention, each of the top circular surfaces 86 of the cast cylinders 72 are chiseled down by a diamond cut fly wheel. A simple downward pounding of the chisel into the circular surface 86 of the cast cylinder 72 can also be used to form the center line 88 and the opposed inclined surfaces 90 and 92. The chisel tool produces the diameter line 88 and, by depressing the diameter line 88 below the edge of the top surface 86 of the cast cylinder 72, upwardly inclined, away from the diameter line 88, opposed semicircular surfaces 90 and 92 are produced. Consistent with this embodiment of the present invention, the diameter line 88 of each of the cast cylinders 72, are parallel to one another and, in the embodiment of the invention shown in FIG. 6, the diameter lines 88 are parallel to the line A—A and center axis of the ring portion of the jewelry design.

Figure 7:
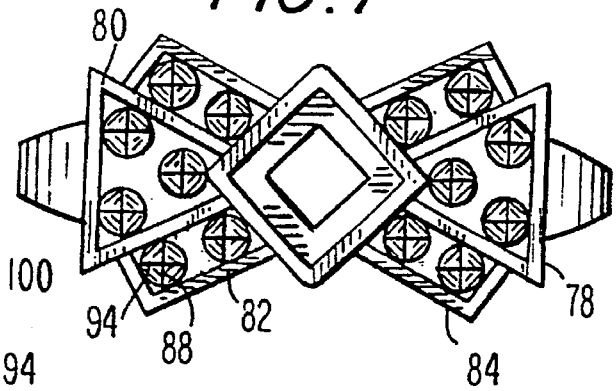
FIG. 7 is a top plan view of the ring of FIG. 6 after the cylinders have been hammered or chiseled a second time, at 90° to the first diameter.
Figure 7A:
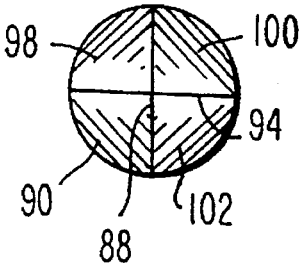
FIG. 7A is an enlarged, top plan view of a cylinder, after being provided with the second chiseling at 90° to the first chiseling.
Figure 8:
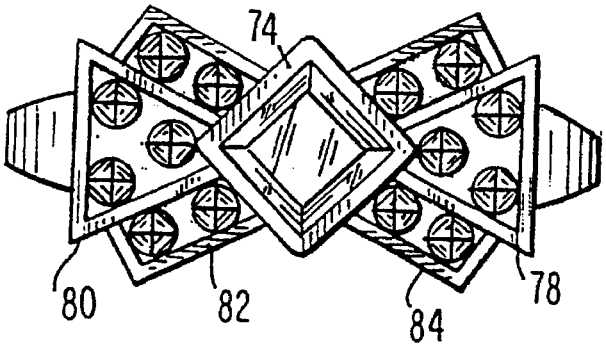
FIG. 8 is a top plan view of the ring embodiment of the present invention after the cylinders have been hammered, as shown in FIGS. 6 and 7, and after the top surface of the cylinders have been plated with rhodium.

FIG. 7 shows the design of the present invention after a second chiseling with a diamond cut fly wheel or hammering or chiseling has been performed. A second set of diameters 94 have been cut, scored, chiseled or otherwise provided to the top surfaces 86 of the cast cylinders 72. In this manner, each of the cast cylinders 72 is provided with a second diameter line 94 perpendicular to the first set of diameters 88. The second set of diameters 94, are at varying angles from about 90° to 150° to the first set of diameters 88 and produce from each surface 90 and 92 a pair of additional inclined surfaces, extending upwardly and outwardly from the diameters 88 and 94. Thus, it will be appreciated that the first set of diameters 88 and the second set of diameters 94 (at angles to diameters 88) produce a plurality (four) of inclined surfaces, 96, 98, 100 and 102 extending away from the center of the cast cylinders. The inclined surfaces extend away from the center point of the circular end of the cylinders. The varying angles of the planes, from cylinder to cylinder, cut into the top surfaces of the cylinder, creates a glistening effect to the overall piece of jewelry, apparently like that of brilliant cut stones.

Consistent with the present invention, the surfaces 96, 98, 100 and 102 are plated or provided with rhodium. After drying, the rhodium can be polished, if needed, and the ultimate effect is that of a faux pavé diamond at the locations of the cast cylinders. Light reflected off of the inclined surfaces provides apparent "fire" to the article. The faux pav é look corresponds to the diamond locations 26 of the sketch of the ring design shown in FIG. 1. Subsequently, of course, as previously mentioned, a gem is mounted in the center gem mounting 74.

Having described this invention with regard to certain specific embodiments, it is to be understood that the description is not meant as a limitation since further modifications may now suggest themselves to those skilled in the art and it is intended to cover such modifications as fall within the scope of the appended claims.

I claim:

1. A method for manufacturing an article to produce a diamond look comprising the steps of:

(a) locating an upwardly extending metal cylinder at the location where a diamond look is desired;

(b) deforming the top surface of the cylinder to produce at least a pair of opposed upwardly inclined and interesting surfaces; and (c) plating said inclined surfaces with a reflective metal.

2. A method as claimed in claim 1 wherein said forming step comprises deforming a second pair of upwardly inclined surfaces at angles to the first pair of inclined surfaces.

3. A method as claimed in claim 2 wherein said first pair of inclined surfaces are semicircular.

4. A method as claimed in claim 2 where said second pair of surfaces are formed at angles extending from between about 90° to 150° to said first pair of inclined surfaces.

5. A method of claim 1 wherein said step of forming is produced by chiseling with a diamond cut fly wheel.

6. A method according to claim 1 wherein said article is incorporated into an article of jewelry.

7. A method as claimed in claim 1 wherein said reflective metal is rhodium.

8. A method as claimed in claim 7 wherein said rhodium plated inclined surfaces are polished.

9. A method as claimed in claim 1 wherein four inclined surfaces are formed.

10. A method as claimed in claim 9 wherein said inclined surfaces extend from the approximate center of said top surface of said cylinder.

* * * * *